US006883400B2

(12) United States Patent
Sugano

(10) Patent No.: US 6,883,400 B2
(45) Date of Patent: Apr. 26, 2005

(54) LIGHT BULB CHANGER

(76) Inventor: Norio Sugano, 5050 Alpine Rd., Portola Valley, CA (US) 94028

( * ) Notice: Subject to any disclaimer, the term of this patent is extended or adjusted under 35 U.S.C. 154(b) by 0 days.

(21) Appl. No.: 10/218,474

(22) Filed: Aug. 12, 2002

(65) Prior Publication Data

US 2004/0025641 A1 Feb. 12, 2004

(51) Int. Cl.[7] ..... H01K 3/32
(52) U.S. Cl. ..... 81/53.11; 81/53.12; 294/19.1
(58) Field of Search ..... 81/53.1, 53.11, 81/53.12; 294/19.1, 19.3

(56) References Cited

U.S. PATENT DOCUMENTS

| | | | | | |
|---|---|---|---|---|---|
| 548,537 | A | | 10/1895 | Green | |
| 558,573 | A | | 4/1896 | Smith | |
| 578,394 | A | * | 3/1897 | Dunn et al. | 81/53.12 |
| 609,421 | A | | 8/1898 | Edwards | |
| 623,180 | A | * | 4/1899 | Rhine | 81/53.12 |
| 634,419 | A | | 10/1899 | Welden | |
| 636,229 | A | * | 10/1899 | Simms | 81/53.12 |
| 659,631 | A | * | 10/1900 | Croteau | 81/53.12 |
| 673,191 | A | | 4/1901 | Arthur | |
| 675,640 | A | * | 6/1901 | Renard | 81/53.12 |
| 750,408 | A | | 1/1904 | Speelman | |
| 801,902 | A | | 10/1905 | Olafson | |
| 809,985 | A | | 1/1906 | Rundberg | |
| 869,836 | A | | 10/1907 | Gaynor | |
| 895,625 | A | | 8/1908 | Gaynor | |
| 925,084 | A | | 6/1909 | Edgerton | |
| 927,908 | A | | 7/1909 | Webb | |
| 977,158 | A | * | 11/1910 | Berkstresser | 81/53.11 |
| 987,562 | A | * | 3/1911 | Ferguson | 81/53.12 |
| 1,056,084 | A | | 3/1913 | Bates | |
| 1,133,613 | A | | 3/1915 | Buss et al. | |
| 1,193,685 | A | * | 8/1916 | Harvey | 81/53.12 |
| 1,201,506 | A | | 10/1916 | Rozelle et al. | |
| 1,202,432 | A | * | 10/1916 | Rozelle et al. | 81/53.12 |
| 1,210,835 | A | | 1/1917 | Price | |
| 1,223,791 | A | | 4/1917 | Jackson | |
| 1,258,430 | A | | 3/1918 | Morris | |
| 1,311,776 | A | | 7/1919 | Rodriguez | |
| 1,449,358 | A | | 3/1923 | Weber | |
| 1,514,814 | A | | 11/1924 | Allen | |
| 1,540,143 | A | * | 6/1925 | Pierpoint | 81/53.12 |
| 1,541,839 | A | | 6/1925 | Metzler et al. | |
| 1,787,670 | A | | 1/1931 | Clarkson | |
| 1,823,170 | A | | 9/1931 | Schulz | |
| 1,847,953 | A | | 3/1932 | Finesey | |
| 2,357,104 | A | * | 8/1944 | Grinnell | 81/53.11 |
| 2,387,846 | A | * | 10/1945 | Hays | 81/53.11 |
| 2,573,002 | A | | 10/1951 | Foster | 294/21 |
| 2,616,743 | A | | 11/1952 | Negley | 294/21 |
| 2,669,478 | A | * | 2/1954 | Bowie | 81/53.11 |
| 2,946,615 | A | | 7/1960 | Yawman, Jr. et al. | 294/20 |
| 2,983,541 | A | | 5/1961 | Maki | 294/20 |
| 3,549,188 | A | | 12/1970 | Cerasoli | 294/21 |
| 3,666,311 | A | * | 5/1972 | McMullin | 29/750 |
| 3,696,694 | A | | 10/1972 | Boro | 81/57.27 |
| 3,731,966 | A | | 5/1973 | Nagy | 294/20 |

(Continued)

*Primary Examiner*—David B. Thomas
(74) *Attorney, Agent, or Firm*—Haverstock & Owens LLP

(57) ABSTRACT

A device for changing a light bulb comprising an outer tube and an inner tube positioned inside the outer tube, wherein the tubes are adjustable along a longitudinal axis. The inner tube having a rotating member which is rotatable about the longitudinal axis by a grip attached to the inner tube. The device comprising a flexible arm with a flex cable running through the arm, wherein the arm is connected to the outer tube. The flex cable in the flexible arm rotates in agreement with the rotating member by means of a transferring mechanism and drives a clasping mechanism comprising a plurality of spring urged fingers. The spring urged fingers are adjustable to clasp different sized light bulbs by an sliding collar coupled to the clasping mechanism. The device also comprises a locking mechanism for allowing or preventing the outer tube and the inner tube from sliding relative to each other at any position.

27 Claims, 4 Drawing Sheets

U.S. PATENT DOCUMENTS

| | | | | | |
|---|---|---|---|---|---|
| 3,776,584 | A | | 12/1973 | Van Gerven | 294/21 |
| 3,788,691 | A | * | 1/1974 | McMullin | 29/750 |
| 3,799,599 | A | | 3/1974 | Jordan | 294/20 |
| 4,167,354 | A | | 9/1979 | Walker | 403/291 |
| 4,218,085 | A | | 8/1980 | Unger | 294/20 |
| 4,385,849 | A | * | 5/1983 | Crain | 403/109.3 |
| 4,611,512 | A | | 9/1986 | Honda | 81/53.1 |
| 4,663,996 | A | | 5/1987 | Grudgfield et al. | 81/53.11 |
| 4,719,826 | A | | 1/1988 | DuBois | 81/53.12 |
| 4,730,960 | A | | 3/1988 | Lewis et al. | 408/127 |
| D297,499 | S | | 9/1988 | Whitney | D8/14 |
| 4,791,835 | A | | 12/1988 | Unger et al. | 81/53.12 |
| 4,844,171 | A | | 7/1989 | Russell, Jr. | 166/377 |
| 4,852,925 | A | | 8/1989 | Lodin | 294/2 |
| 4,864,899 | A | | 9/1989 | Morse | 81/53.11 |
| 4,876,929 | A | | 10/1989 | Kozak | 81/57.43 |
| 4,901,606 | A | | 2/1990 | Christensen | 81/57.11 |
| 4,970,921 | A | | 11/1990 | Fagan | 81/121.1 |
| 5,103,695 | A | | 4/1992 | Dolle et al. | 81/53.11 |
| 5,123,311 | A | | 6/1992 | Dymek | 81/177.6 |
| 5,148,723 | A | | 9/1992 | Newman, Sr. et al. | 81/53.11 |
| 5,218,889 | A | | 6/1993 | Brockberg | 81/53.11 |
| 5,317,939 | A | | 6/1994 | Marinescu | 81/53.11 |
| 5,330,243 | A | | 7/1994 | Held | 294/19.1 |
| 5,379,666 | A | | 1/1995 | Held | 81/53.1 |
| 5,385,420 | A | | 1/1995 | Newman, Sr. et al. | 403/299 |
| 5,386,744 | A | | 2/1995 | Garcia | 81/53.11 |
| 5,436,526 | A | | 7/1995 | Hohaus et al. | 131/51 |
| 5,458,026 | A | | 10/1995 | Southard et al. | 81/53.1 |
| 5,464,407 | A | | 11/1995 | McGuire | 606/86 |
| 5,490,438 | A | | 2/1996 | Zupo et al. | 81/53.11 |
| 5,546,291 | A | | 8/1996 | Simes | 362/223 |
| 5,553,373 | A | | 9/1996 | Sprayberry | 29/758 |
| 5,564,852 | A | | 10/1996 | Maxwell et al. | 403/97 |
| 5,572,913 | A | | 11/1996 | Nasiell | 81/177.6 |
| 5,593,196 | A | * | 1/1997 | Baum et al. | 294/19.1 |
| 5,647,622 | A | | 7/1997 | Schectman | 294/19.1 |
| 5,649,255 | A | | 7/1997 | Schieltz | 396/427 |
| 5,692,417 | A | | 12/1997 | Irpino | 81/53.12 |
| 5,697,269 | A | | 12/1997 | Tseng | 81/177.6 |
| 5,730,033 | A | | 3/1998 | Mitrowski | 81/53.11 |
| 5,752,287 | A | | 5/1998 | Wheat | 15/176.2 |
| 5,765,453 | A | | 6/1998 | Mims | 81/53.11 |
| 5,797,918 | A | | 8/1998 | McGuire et al. | 606/104 |
| 5,802,692 | A | | 9/1998 | Philippe | 29/263 |
| 5,806,903 | A | | 9/1998 | George | 294/19.1 |
| 5,809,850 | A | | 9/1998 | Tickner | 81/53.11 |
| 5,823,073 | A | | 10/1998 | Tickner | 81/53.11 |
| 5,941,139 | A | | 8/1999 | Vodehnal | 81/57.43 |
| 6,453,777 | B1 | * | 9/2002 | Newman et al. | 81/53.11 |

* cited by examiner

LIGHT BULB CHANGER

FIELD OF THE INVENTION

The present invention relates to a remote access tool. More specifically, the present invention relates to a device designed to remove and replace light bulbs which are held at a variety of angles and heights and are otherwise inaccessible from ground level.

BACKGROUND OF THE INVENTION

Numerous light bulb removal tools have been patented which alleviate the problems associated with replacing light bulbs from remote locations. One such problem is accessibility. Overhead lights are purposefully positioned out of reach to minimize risks associated with heat burns and unintentional contact which could result in globe glass breakage. Another problem stems from the variety of angles from which bulbs must be extracted and replaced from these remote locations, such as from chandeliers and hanging light arrangements. Another problem is the adjustability of the handle to reach light bulbs at varying distances.

U.S. Pat. No. 1,514,814 to Allen, discloses an electric bulb holder which has bulb gripping arms that are pivotally connected to a slidable member which causes the bulb gripping arms to spread around the light bulb and then collapse to grip the light bulb. Once the user has a grip of the light bulb, she must rotate the whole bulb holder to screw or unscrew the light bulb. Further, the handle in this patent does not have a flexible arm for reaching light bulbs that are at an angle.

U.S. Pat. No. 2,983,541 to Maki discloses a device for removing or placing light bulbs in sockets. Specifically, the device taught by Maki consists of a fixed rod with a bendable arm for reaching light bulbs at different angles. The patent discloses using a helicoidal operating member inside the bendable arm which is bendable and rotatable. However, the device taught by Maki, by having a fixed rod, does not allow the user to adjust the rod to different heights. Also, the user must use an air bulb to create suction in an engaging cup to engage the light bulb. This is disadvantageous to the user, because the cup is not adjustable to engage different sized light bulbs.

U.S. Pat. No. 2,616,743 to Negley discloses a light bulb changer having a rigid handle and a bendable arm attached to the handle. Although this light bulb changer allows the user to bend the arm to engage light bulbs at different angles, the light bulb changer does not allow the user to adjust the handle to different heights. Further, the light bulb changer taught by Negley does not allow the user to adjust the mechanism to fit differently sized light bulbs.

U.S. Pat. Nos. 1,202,432 and 1,201,506 to Rozelle et al., both disclose an adjustable device for placing and removing electric light bulbs. Specifically, the device taught in these patents utilizes a rod which has a pivoting section about a clamp screw for reaching light bulbs at different angles. However, the pivoting section is locked by tightening the clamp screw, which is burdensome on the user, because the user must use a screw driver, or some other external tool, to lock the pivoting shaft. Further, the rods taught in this patent are also adjustable to reach light bulbs at different heights, but the mechanism to lock the rods at a desired height is limiting. The mechanism to prevent the sliding of the rods consists of pins positioned along the rod which are configured to slide into a bayonet slot cut into the outer surface of the rod. Therefore, the user can only adjust the rod at certain heights, which is burdensome if the light bulb is at a height that does not correspond to any of the positions available on the rod.

SUMMARY OF THE INVENTION

A light bulb changer includes an outer tube and an inner tube positioned within the outer tube. The outer and inner tubes are adjustable along a longitudinal axis in relation to each other. The inner tube has a rotating member which is rotatable about the longitudinal axis by a corresponding grip. The light bulb changer also includes a flexible arm coupled with the outer tube with a flex cable running through the arm. The flex cable in the flexible arm rotates in agreement with the rotating member by means of a transferring mechanism and drives a clasping mechanism comprising a plurality of spring urged fingers. The spring urged fingers are adjustable to clasp different sized light bulbs by a sliding collar coupled to the clasping mechanism. The device also comprises a locking mechanism for allowing or preventing the outer tube and the inner tube from sliding relative to each other at any position when the locking mechanism is engaged.

DETAILED DESCRIPTION OF THE PREFERRED EMBODIMENT

Figure 1:
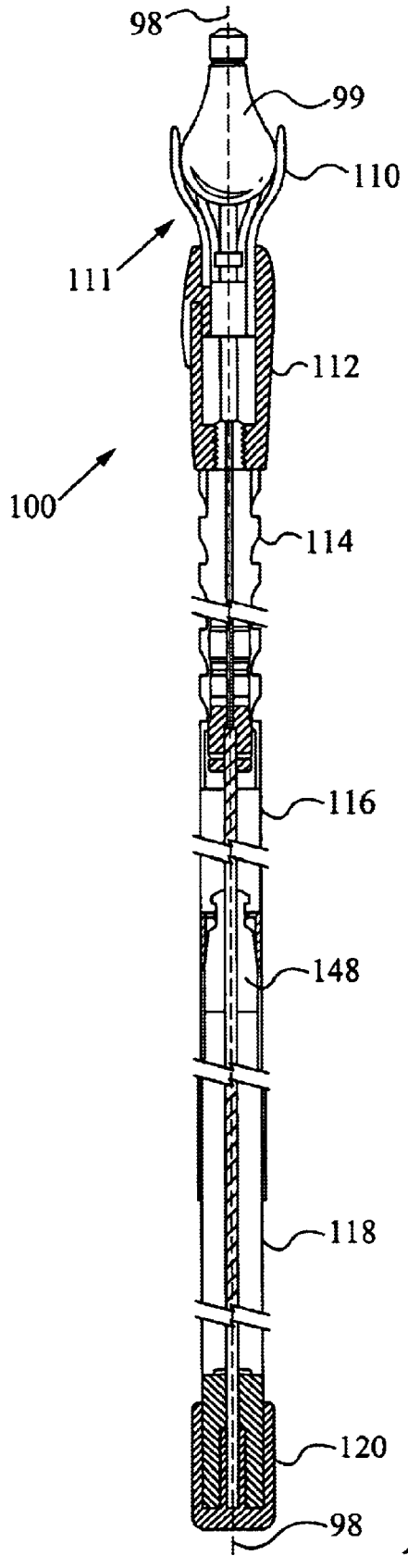
FIG. 1 illustrates a segmented cross sectional view of the light bulb changer device for engaging a light bulb in accordance with the present invention.

FIG. 1 shows a segmented cross sectional view of the light bulb changer device 100 for engaging a light bulb 99. Generally, the device 100 shown in FIG. 1 has a clasping mechanism 111 comprising several fingers 110 for clasping the light bulb 99, a head unit 112, a flexible arm 114, an outer tube 116, an inner tube 118 located within the outer tube 118 slidable along a longitudinal axis 98 which passes through the center of both tubes, and a turning grip 120 coupled to the inner tube 118. The specifics of each section will be discussed in detail below and in the additional drawings.

Figures 2A, 2B:
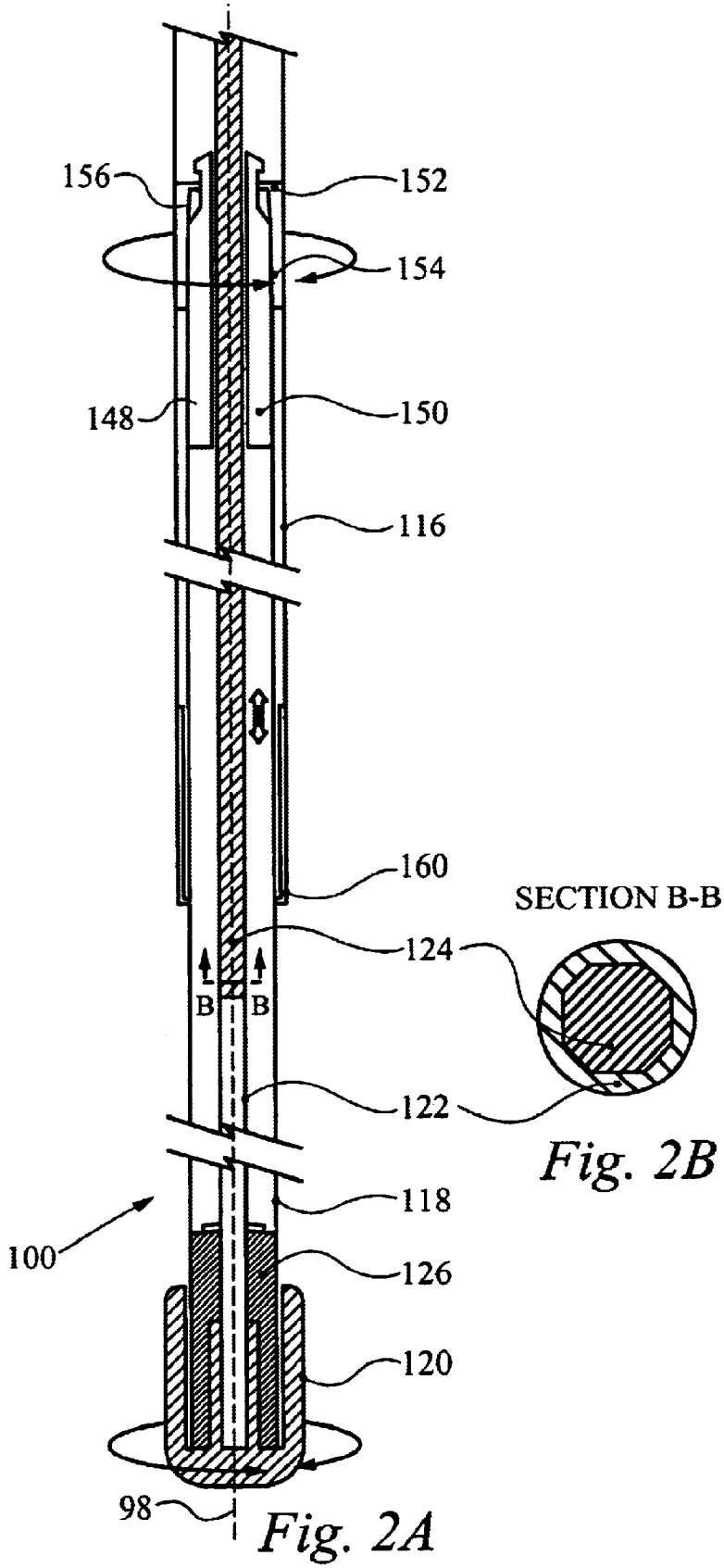
FIG. 2*a* illustrates a cross sectional view of the light bulb changer device of the present invention below the locking mechanism.
FIG. 2*b* illustrates a cross sectional view of the light bulb changer device of the present invention in FIG. 2*a* along section B—B.

FIG. 2*a* illustrates a cross sectional view of the light bulb changer 100 below the locking mechanism 148. The inner tube 118 has an upper and lower end and is positioned within the outer tube 116 which also has an upper and lower end. The tubes are also positioned such that the upper ends of the tubes and the lower ends of the tubes correspond to each other respectively and are slidable with respect to each other along the same longitudinal axis 98. It must be noted, however, that although the preferred embodiment has one inner tube and one outer tube, more tubes may be coupled together along the longitudinal axis 98, as appropriate, to allow the user to reach light bulbs at varying distances.

The light bulb changer 100 in FIG. 2*a* has a lock notch 160 which prevents the inner tube 118 from sliding out of the outer tube 116. As shown in FIG. 2*a*, the lock notch 160 is located on the proximal end of the outer tube 116 and is positioned such that it does not allow the locking mechanism 148 to slide past the lock notch 160. The light bulb changer 100 also has a locking mechanism 148 which controls the ability of the tubes 116 and 118 to slide with respect to each other at any point along the longitudinal axis 98. In the preferred embodiment, the locking mechanism 148 comprises a tapered bushing 150 coupled to a lock sleeve 152 where the tapered bushing 150 has an end 158 that is attached to the upper end of the inner tube 118. Preferably, the tapered bushing 150 is threaded and tapered at its outer surface 154, and the lock sleeve 152 is also threaded and tapered along its inner surface 156. Thus, the locking mechanism 148 is configured such that the threaded portion of the outer surface 154 of the tapered bushing 150 is registered with the threaded portion of the inner surface 156 of the lock sleeve 152. To lock the locking mechanism 148, the user turns the inner tube 118 to rotate the threaded portion 154 of the tapered bushing 150 upwards against the threaded portion 156 of the lock sleeve 152. The tapered shape of the tapered bushing 150 in its upward movement forces the lock sleeve 152 to expand about the longitudinal axis 98 and press against the inside of the outer tube 116. As a result, the inner tube 118 is prevented from sliding relative to any point on the outer tube 116 along the longitudinal axis 98.

Figure 3:
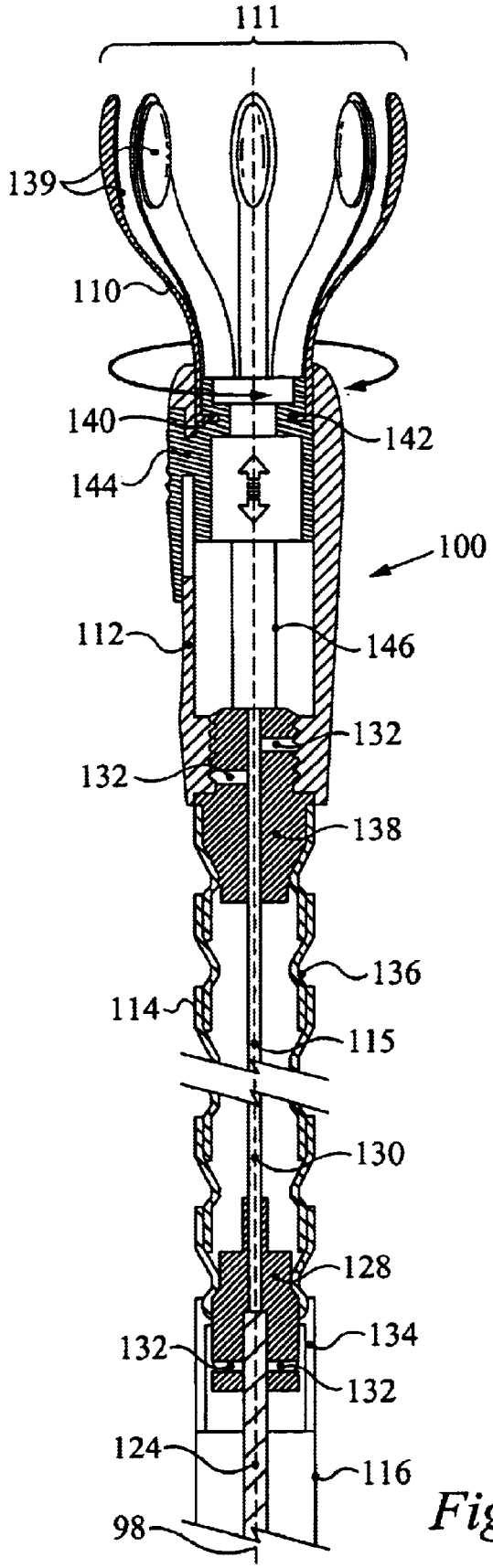
FIG. 3 illustrates a cross sectional view of the light bulb changer device of the present invention above the transferring mechanism.

The turning grip 120 is positioned around the lower end of the inner tube 118 and is coupled to a hollow rotating shaft 122, in which the rotating shaft 122 extends along the longitudinal axis 98 from the turning grip 120 to a transferring mechanism 128, illustrated in FIG. 3. The turning grip 120 rotates freely about the longitudinal axis 98 and operates the rotating shaft 122 about the longitudinal axis 98. Preferably, the rotating shaft 122 is retained within the lower end of the inner tube 118 by a grip bushing 126, which is pressed into the bottom of the inner tube 118 between the shaft 122 and the turning grip 120. The hollow rotating shaft 122 has an outer cylindrical shape and an inner square cavity for housing a rotating rod or member 124, as shown along cross section B—B in FIG. 2*b*. The rotating rod 124 is located within the rotating shaft 122 and extends along the longitudinal axis 98 to the transferring mechanism 128, illustrated in FIG. 3. As shown in FIG. 2*b*, the rotating rod 124 preferably has a square shaped cross section to correspond to the inside shape of the rotating shaft 122. However, it should be noted that the rotating rod 124 may have any other shape. Thus, the rotating rod 124 rotates in the same direction as the rotating shaft 122 about the longitudinal axis 98.

FIG. 3 illustrates a cross sectional view of the light bulb changer 100 above the transferring mechanism 128. Preferably, the rotational motion of the rotating rod 124 is transferred to a flex cable 130 by a transferring mechanism 128. The transferring mechanism 128 is preferably located within a connector 134 which serves to connect the upper end of the outer tube 116 to the flexible arm 114. However, the transferring mechanism 128 can be located anywhere in the device 100. In the preferred embodiment, the transferring mechanism 128 is made of plastic cable bushing and is attached to the flex cable 130 by crimping metal ferrule around the flex cable 130. Also, the transferring mechanism 128 is attached to the rotational rod 124 by two set screws 132. Thus, the rotation of the rod 124 is transferred by the set screws 132 to the transferring mechanism 128. This, in turn, causes the transferring mechanism 128 to rotate with the rod 124. As a result, the rotation of the transferring mechanism 128 causes the flex cable 130 to rotate in agreement with the rod 124.

Figure 4:
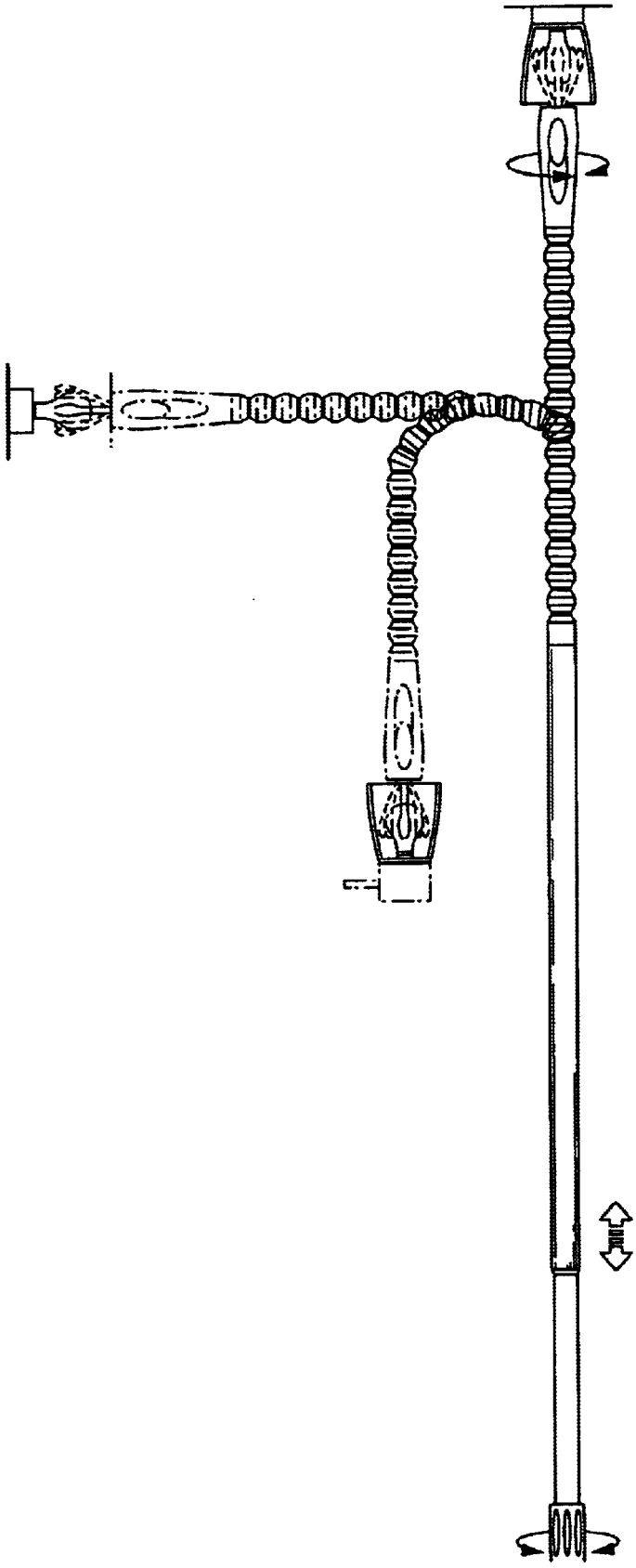
FIG. 4 illustrates the light bulb changer device of the present invention engaging light bulbs in three different positions.

The flex cable 130 is preferably contained in a flexible shaft 115 within the flexible arm 114. However, it must be noted that the flexible shaft 115 is not required. The flexible arm 114 is made up of several individual links 136 connected end to end and movable relative to each other. Preferably, the links 136 are ball and socket joints coupled together to be movable and twistable in any direction. Also, the links 136 can hold a certain configuration solely by friction. Details concerning the flexible arm 114 may be found in U.S. Pat. No. 5,572,913 to Nasiell, which is hereby incorporated by reference. The flex cable 130 is also bendable at any angle and rotates when bent. Therefore, the flex cable 130 will rotate in agreement with the rod 124 at any angle, even when the flexible arm 114 is rotated 180 degrees to the inner and outer tubes (as shown in FIG. 4).

The flexible arm 114 is preferably coupled to a head bushing 138, where one end of the head bushing 138 is positioned and freely rotatable inside the flexible arm 114. The other end of the head bushing 138 is threaded to a head unit 112. The flex cable 130 is coupled to the head unit 112 by a pair of set screws 132. The set screws 132 allow the head unit 112 to rotate in agreement with the flex cable 130. The head unit 112 is also coupled to a set of fingers 110, also referred to as a clasping mechanism 111, such that the rotation of the head unit 112 and the clasping mechanism 111 rotate in agreement with each other.

Preferably, the fingers 110 extend in an octagonal pattern with pads 139 on the interior surface of each finger 110, which aid in gripping the light bulb 99. Preferably, each pad 139 is set and attached to the interior of each finger 110 by an adhesive, such as glue. Alternatively, any other appropriate means of attaching the pad 139 to the finger 110 are used. The fingers 110 are tensioned or spring urged to snugly fit over the light bulb 99 to screw or unscrew the light bulb 99 from its socket. The set of fingers 110 is also connected to a sliding collar 144. Specifically, each finger 110 in the clasping mechanism 111 has a protruding tab 140 set into a circular groove 142 around the sliding collar 144. The sliding collar 144 is positioned inside the head unit 112 and slides along the longitudinal axis 98 within the cavity 146 of the head unit 112. The sliding collar 144 slides in various positions along the head unit 112 by saw-tooth detents (not shown) on the head unit 112. Depending on the position of the sliding collar 144, the spacing between the fingers 110 increases or decreases to allow the clasping mechanism 111 to clasp different sized light bulbs 99.

Preferably, each finger is shaped such that a portion of the finger 110 is close to the longitudinal axis 98 near the sliding collar 144, and gradually extends in an outward direction, away from the longitudinal axis 98 to the area where the pad 139 is attached. Further, each finger 110 is preferably made of an elastic material to allow the fingers 110 to bend toward or away from each other, depending on where the collar 144 is positioned. Thus, the user is able to adjust the fingers 110 to be far apart from each other and have a large distance between oppositely facing fingers 110 when the sliding collar 144 is in the upper position, as shown in FIG. 3. In contrast, the user is also able to adjust the fingers to be close together and have a smaller distance between oppositely facing fingers 110 when the collar 144 is slid to the lower position (not shown). This feature allows the user to adjust the clasping mechanism 111 mechanism to engage bulbs of different diameters and sizes from flood lights to Christmas bulbs.

In operation, as shown in FIG. 4, the user adjusts the fingers 110 to correspond to fit snugly around a light bulb 99 by moving the sliding collar 144 upwards or downwards on the head unit 112. The flexible arm 114 is then adjusted to the desired configuration to allow the clasping mechanism 111 or fingers 110 to be able to reach the light bulb 99 in any orientation, including hard to reach areas. The user then adjusts the length of the light bulb changer 100 by turning the inner tube 118 clockwise, thereby loosening the locking mechanism 148, and sliding the inner tube 118 within the outer tube 116 accordingly. Once the desired length is achieved, the user prevents the tubes from sliding in relation to each other by turning the inner tube 118 counter clockwise, thereby tightening the locking mechanism 148.

The user then positions the fingers 110 around the light bulb 99 and engages the light bulb 99. Once the light bulb 99 is engaged, the user turns the turning grip 120 counterclockwise, causing the fingers 110 to rotate and removes the light bulb 99 from the socket. Specifically, the turning grip 120 turns the rotating rod 124 via the rotating shaft 122. The rotation of the rotating rod 124 is transferred by the transferring mechanism 128 to the flex cable 130, which is within the flexible arm 114. The rotation of the flex cable 130 is then imparted to the clasping mechanism 111 and fingers 110 via the bushing mechanism 138 and head unit 112. Thus, a clockwise rotation of the turning grip 120 causes the fingers 110 to rotate clockwise in any orientation of the flexible arm 114. Likewise, a counterclockwise rotation of the turning grip 120 causes the fingers 110 to rotate counterclockwise in any orientation of the flexible arm 114.

The user is then able to change the light bulb 99 by loosening the locking mechanism 148 and sliding the inner tube 118 to shorten the overall length of the light bulb changer 100. With the bulb 99 in reachable distance, the user can then remove the light bulb 99 from the fingers 110. Screwing in a light bulb 99 is done by the same method, except that the user turns the turning grip 120 counterclockwise.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modification s may be made in the embodiment chosen for illustration without departing from the spirit and scope of the invention.

I claim:

1. A light bulb changing tool comprising:

a. means for clasping a light bulb having an adjustable dimension;

b. means for varying the adjustable dimension coupled to the means for clasping;

c. means for rotating the means for clasping, the means for rotating coupled to the means for clasping;

d. flexible means for positioning the means for clasping in any configuration in relation to the means for rotating such that rotation of the means for rotating causes the means for clasping to rotate to selectively tighten and loosen the light bulb; and e. means for selectively adjusting an overall length of the light bulb changing tool.

2. A light bulb changing tool comprising:

a. a first tube member and a second tube member slidably moveable relative to one another along a longitudinal axis;

b. a rotating member positioned within the first and second tube members, wherein the rotating member operates in a rotational motion about the longitudinal axis;

c. a flexible arm having a first end, a second end and a flexible cable, wherein the first end of the flexible arm is coupled to the first tube member;

d. a transferring mechanism coupled between the rotating member and the flexible cable whereby the flexible cable rotates in agreement with the rotating member;

e. a clasping mechanism coupled with the second end of the flexible arm, the clasping mechanism coupled with the flexible cable and in rotational agreement with the flexible cable to selectively tighten and loosen a light bulb, the clasping mechanism having an adjustable clasping dimension; and f. a locking mechanism configured between the first tube member and the second tube member for controlling the slidable movement therebetween along the longitudinal axis.

3. The light bulb changing tool as claimed in claim 2 further comprising a grip element coupled to the second tube member wherein the grip element is freely rotatable about the longitudinal axis.

4. The light bulb changing tool as claimed in claim 3 further comprising a rotating shaft coupled to the grip element wherein the rotating shaft contains the rotating member and is rotatable about the longitudinal axis.

5. The light bulb changing tool as claimed in claim 2 wherein the flexible arm further comprises a flexible shaft for housing the flexible cable therethrough.

6. The light bulb changing tool as claimed in claim 2 wherein the transferring mechanism further comprises a cable bushing positioned between the first tube member and the second tube member, the cable bushing coupled to the rotating member by a plurality of set screws, the cable bushing coupled to the flexible cable by crimped metal ferrule.

7. The light bulb changing tool as claimed in claim 2 further comprising a head unit coupled with the flexible arm wherein the head unit rotates in agreement with the flexible cable.

8. The light bulb changing tool as claimed in claim 7 wherein the head unit further comprises a sliding collar movable along the head unit, the sliding collar for adjusting the clasping dimension of the clasping mechanism.

9. The light bulb changing tool as claimed in claim 2 wherein the clasping mechanism further comprises a plurality of spring urged fingers.

10. The light bulb changing tool as claimed in claim 2 wherein the flexible arm further comprises a plurality of individual links coupled end to end and movable relative to each other, thereby enabling the flexible arm to be twisted into a plurality of different positions by friction between the links.

11. The light bulb changing tool as claimed in claim 2 wherein the locking mechanism further comprises:

a. a tapered element coupled to the first tube member wherein the tapered element is configured to rotate about and move along the longitudinal axis; and b. a lock member positioned within the second tube member and coupled to the tapered element wherein the movement of the tapered element along the longitudinal axis varies a dimension of the lock member.

12. A tool for changing a plurality of light bulbs of different sizes comprising:

a. a tubular element having a varying length dimension, wherein the tubular element has a longitudinal axis therethrough;

b. an inner rotating element coupled with the tubular element, wherein the inner rotating element is rotatable about the longitudinal axis;

c. a flexible arm coupled to the tubular element;

d. a flex cable positioned within the flexible arm, the flex cable in rotatable agreement with the inner rotating element;

e. a clasping mechanism having a variable dimension, the clasping mechanism coupled to the flex cable, wherein the clasping mechanism is in rotatable agreement with the flex cable to selectively tighten and loosen a light bulb;

f. an adjusting mechanism coupled to the clasping mechanism wherein the variable dimension is altered relative to a position of the adjusting mechanism; and g. a locking element coupled to the tubular element configured to control the length dimension.

13. The light bulb changing tool as claimed in claim 12 wherein the tubular element further comprises a first tube member and a second tube member slidably moveable relative to one another along the longitudinal axis.

14. The light bulb changing tool as claimed in claim 12 wherein the inner rotating element further comprises:

a. a rod rotatable about the longitudinal axis; and b. a rotating shaft for containing the rod wherein the rod is freely moveable along the longitudinal axis within the rotating shaft, and further wherein the rotating shaft is rotatable about the longitudinal axis and in rotational with the rod.

15. The light bulb changing tool as claimed in claim 14 further comprising a grip element freely rotatable about the longitudinal axis, wherein the grip element is coupled to the rotating shaft.

16. The light bulb changing tool as claimed in claim 12 wherein the flexible arm further comprises a plurality of individual links coupled end to end and movable relative to each other, thereby enabling the flexible arm to be twisted into a plurality of different positions by friction between the links.

17. The light bulb changing tool as claimed in claim 12 wherein the flexible arm further comprises a flexible shaft for housing the flex cable therethrough.

18. The light bulb changing tool as claimed in claim 12 wherein the adjusting mechanism further comprises a sliding collar movable along a head unit, wherein the head unit is coupled to the flexible arm and rotatable in agreement with the flex cable.

19. The light bulb changing tool as claimed in claim 12 wherein the clasping mechanism further comprises a plurality of spring urged fingers.

20. The light bulb changing tool as claimed in claim 13 wherein the locking element further comprises:

a. a tapered clement coupled to the first tube member wherein the tapered element is configured to rotate about and move along the longitudinal axis; and b. a lock member positioned within the second tube member and coupled to the tapered element wherein the movement of the tapered element along the longitudinal axis varies a dimension of the lock member.

21. The light bulb changing tool as claimed in claim 12 further comprising a transferring mechanism coupled between the inner rotating element and the flex cable, wherein the transferring mechanism comprises a cable bushing positioned within the tubular element, the cable bushing coupled to the inner rotating element by a plurality of set screws, the cable bushing coupled to the flex cable by crimped metal ferrule.

22. A light bulb changing tool comprising:

a. an outer tube having an upper end and a lower end along a longitudinal axis and an outer tube diameter;

b. an inner tube having an inner tube diameter, wherein the inner tube diameter is smaller than the outer tube diameter and at least a portion of the inner tube is slidably positioned inside the outer tube, the inner tube further comprising:

i. a rotatable hollow shaft along the longitudinal axis; and ii. an inner rotating element positioned within the hollow shaft such that the inner rotating element rotates in agreement with the hollow shaft about the longitudinal axis;

c. a flexible arm having a proximal end and a distal end, the proximal end coupled to the upper end of the outer tube;

d. a flex cable positioned within the flexible arm and coupled with the inner rotating element;

e. a bushing mechanism for rotating the flex cable in rotational agreement with the inner rotating element;

f. a head having a first end and a second end wherein the second end is coupled to the distal end of the flexible arm, the head in rotational agreement with the flex cable;

g. a plurality of clasping fingers having a varying dimension therebetween, the plurality coupled in rotational agreement with the head to selectively tighten and loosen a light bulb;

h. an adjustable collar coupled with the fingers such that the varying dimension adjusts with respect to a position of the collar; and i. a locking element coupled to the inner tube and the outer tube, the locking element for allowing and preventing the inner tube and the outer tube from sliding in relation to one another.

23. The light bulb changing tool as claimed in claim 22 wherein the flexible arm further comprises a flexible shaft for housing the flex cable therethrough.

24. The light bulb changing tool as claimed in claim 22 further comprising a grip coupled to the rotatable hollow shaft wherein the grip is freely rotatable about the longitudinal axis.

25. The light bulb changing tool as claimed in claim 22 wherein the flexible arm further comprises a plurality of individual links coupled end to end and movable relative to each other, thereby enabling the flexible arm to be twisted into a plurality of different positions by friction between the links.

26. The light bulb changing tool as claimed in claim 22 wherein the bushing mechanism further comprises a cable bushing positioned within the outer tube, the cable bushing coupled to the rotating member by a plurality of set screws, the cable bushing coupled to the flex cable by a crimped metal ferrule.

27. A method of manufacturing a light bulb changing tool comprising:

a. providing a tubular element having a varying dimension wherein the tubular element has a longitudinal axis therethrough;

b. configuring the tubular element to have an inner rotating element wherein the inner rotating element is freely rotatable about the longitudinal axis;

c. providing a flexible arm coupled to the tubular element, the flexible arm further comprising a flex cable, the flex cable in rotatable agreement with the inner rotating element by a transferring mechanism;

d. providing a clasping mechanism coupled to the flex cable, wherein the clasping mechanism is substantially in rotatable agreement with the flex cable to selectively tighten and loosen a light bulb;

e. providing an adjusting mechanism coupled to the clasping means wherein a dimension of the clasping mechanism is altered relative to a position of the adjusting mechanism; and f. providing a locking element coupled to the tubular element configured to control the length dimension.

* * * * *